United States Patent [19]

Schmidt

[11] 4,219,951

[45] Sep. 2, 1980

[54] FILE FOLDER WITH FASTENING MECHANISM ON THE INSIDE

[75] Inventor: Otto Schmidt, Ronnenberg, Fed. Rep. of Germany

[73] Assignee: Dipl. Ing. A. Berglein, Hanover, Fed. Rep. of Germany

[21] Appl. No.: 873,097

[22] Filed: Jan. 30, 1978

[30] Foreign Application Priority Data

Sep. 24, 1977 [DE] Fed. Rep. of Germany ..... 2747628

[51] Int. Cl.[2] ..... G09F 19/00

[52] U.S. Cl. ..... 40/530; 40/359; 402/75

[58] Field of Search ..... 402/74, 75, 76, 77; 40/359, 530, 10 R, 360; 281/29

[56] References Cited

U.S. PATENT DOCUMENTS

| | | | |
|---|---|---|---|
| 276,962 | 5/1883 | Quillflet | 229/40 |
| 1,191,961 | 7/1916 | Griffith | 281/29 |
| 1,271,484 | 7/1918 | Laurent | 402/75 X |
| 2,129,799 | 9/1938 | Viens | 402/74 |
| 2,804,872 | 9/1957 | Kraut | 281/29 X |
| 3,638,967 | 2/1972 | Mullins | 402/75 X |

FOREIGN PATENT DOCUMENTS

| | | | |
|---|---|---|---|
| 783401 | 4/1968 | Canada | 402/74 |
| 1388218 | 12/1964 | France | 402/74 |

*Primary Examiner*—Louis G. Mancene
*Assistant Examiner*—Wenceslao J. Contreras
*Attorney, Agent, or Firm*—Max Fogiel

[57] ABSTRACT

A file folder having a fastener mechanism on the inside and provided with a wide back for carrying identification markings and covers extending from the wide back. The folder is made of one piece of hard cardboard on its open side, and has an additional narrow identification back. This narrow identification back, as well as the wide identification back, is connected by folding and bending with an adjacent cover each, through a side edge strip connected in one piece and produced by folding and bending. The side edge strip reaches around the free edge of the other folder cover and is disconnectably attached to it. The side edge strip of the additional narrow identification back has, on its free edge, a projecting insertion tongue, and the facing folder cover has an associated insertion slot. The insertion tongue of the side edge strip has on it a cross groove produced by folding so that the part of the insertion tongue projecting beyond this cross groove by reaching around the insertion slot edge, and through friction with it, causes a self-holding effect of the insertion tongue in the insertion groove.

6 Claims, 5 Drawing Figures

8
10
9
7
12
1
4
6
3
12
5
5
2
11

9
8
7
1
4
3
2

FILE FOLDER WITH FASTENING MECHANISM ON THE INSIDE

BACKGROUND OF THE INVENTION

The present invention relates to a file folder with fastener mechanism on the inside, a wide back for carrying the identification, and covers emanating therefrom.

The wide identification mechanism necessary for accommodating the mechanism between the two file covers because of the row stacking of the files on shelves and in cabinets, results in an undesirable space requirement with respect to the width. Also, by stacking the papers and vouchers to be stored in the folders between the two file covers, with the rear side facing the fastener mechanism, there result pointed triangular or wedge shapes of the folders which produce unused dead spaces. These are empty towards the rear open side; because of the row stacking of the folders on the shelves, they require an undesirable large wide space. The horizontal triangular or wedge shape of the folders reduces their ability to stand vertical. With the present folders, the connection points with pasted-on linen tapes between the file covers and the identification backs and the disconnectable connection of the additional narrow identification back to the file covers cause difficulties in the manufacture of the file folder and also with respect to the stable row stacking of the folders on the shelves which make production cumbersome and expensive.

Experiments for the partial removal of these numerous shortcomings resulted in difficulties and considerable expense in the manufacture and handling of the folders. As a result, their introduction was difficult or impossible.

It is therefore an object of the present invention to overcome the recognized but unremedied disadvantages by providing a substantially simple construction so as to result in low manufacturing costs.

Another object of the present invention is to provide a file folder which results in substantial savings in space when the folders are stacked or placed on shelves or cabinets.

A further object of the present invention is to provide a file folder which has a substantially long useful service life.

SUMMARY OF THE INVENTION

The objects of the present invention are achieved by providing that the file folder is made of a single piece of hard cardboard on its open side, and has an additional narrow back which, like the wide back, is connected by folding and bending with one of the two facing folder covers; a side edge strip connected to it by folding and bending it, grasps the free edge of the other folder cover and is disconnectably attached to it.

The side edge strip of the additional small back has an insertion tongue and the facing folder cover has the associated insertion slot. The insertion tongue of the side edge strip has a cross groove produced by folding. The part of the insertion tongue projecting beyond this cross groove by reaching behind the insertion slot rim and friction with it, produces a self-holding effect of the insertion tongue in the insertion slot.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
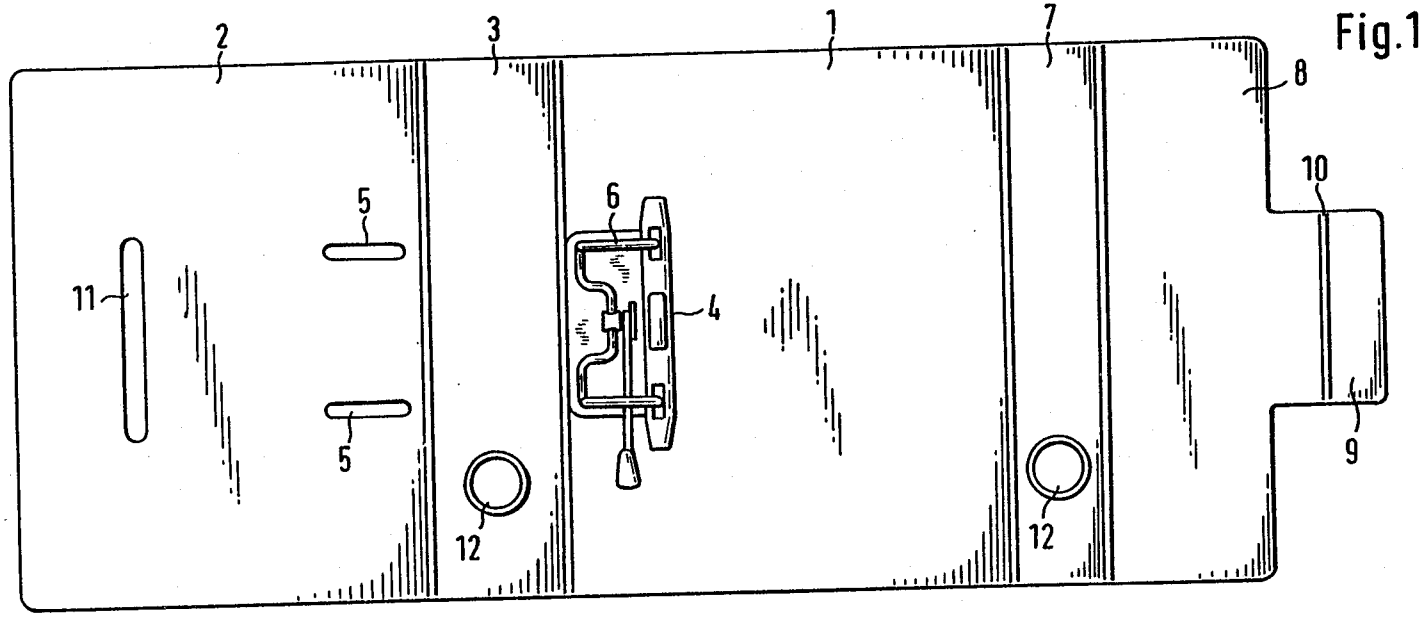
FIG. 1 shows an embodiment of the file folder made of one piece of hard cardboard with attached folder covers, fastening mechanism, wide and additional narrow identification back at the open folder side, side edge strips with insertion tongue connections to the other folder cover in a partially unfolded stretched position, when viewed from the inside.
Figure 2:
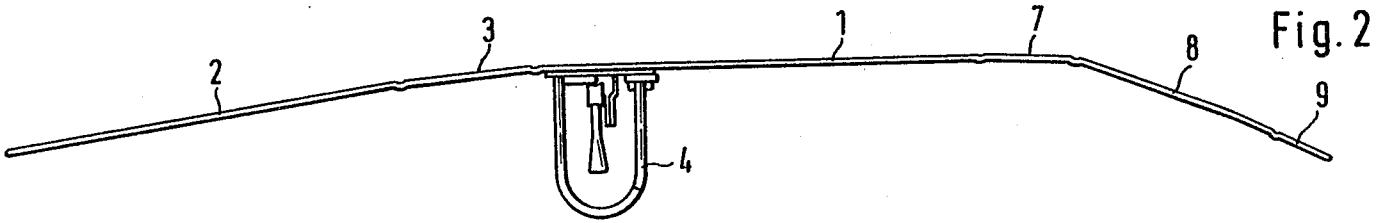
FIG. 2 shows the embodiment of FIG. 1, when viewed from the side in FIG. 1.
Figure 3:
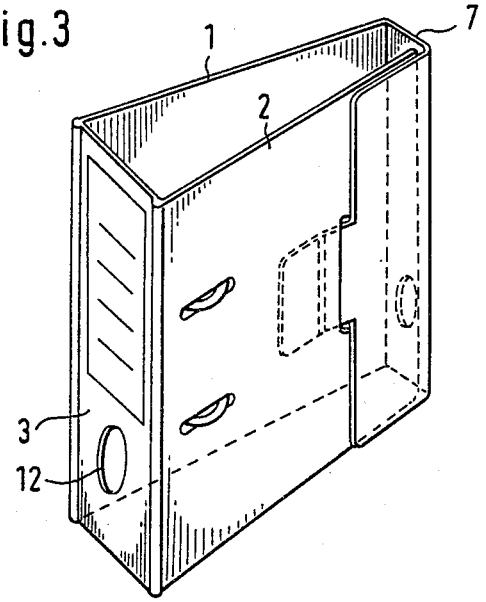
FIG. 3 shows a closed folder, in perspective, from the closure side.

FIGS. 1 and 2 show the two folder covers which issue by folding and bending from a wide back 3 corresponding to the height of the fastening mechanism. On the folder cover 1, near the wide back 3, the fastening mechanism 4 is securely attached, and in file cover 2 the passage slots 5 for the bows 6 of the fastening mechanism 4 are attached. To the free edge of folder cover 1, there is an additional narrow right-angle bent folder back 7 produced by folding and bending. On its free side edge, the folder back has a right-angle bent side edge strip 8 also produced by folding and bending. With the folder closed, the side edge strip reaches around the free edge of the folder cover 2. This side edge strip 8 has a projecting insertion tongue 9 which has a cross groove 10 produced by folding, so that the part of the tongue 9 projecting beyond the groove through friction at the insertion slot edge of the insertion slot 11, produces a self-holding effect on the cover 2.

The additional folder back 7 is considerably smaller than the wider standard folder back 3 near the fastening mechanism 4. Both folder backs 3 and 7 are preferably plane and have an outside inscription area and grip holes 12. The vouchers, papers, etc. are deposited or filed in the folder fastened as previously on the fastening mechanism 4.

Figure 4:
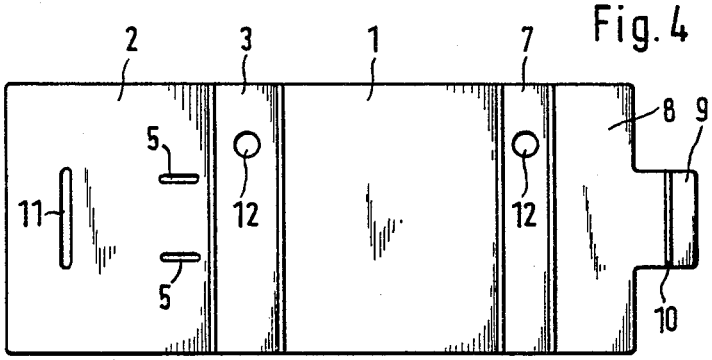
FIG. 4 shows an embodiment of a layout for the folder in one piece for all parts with the folds seen from the top and the insertion tongue with cross groove, from the rear.
Figure 5:
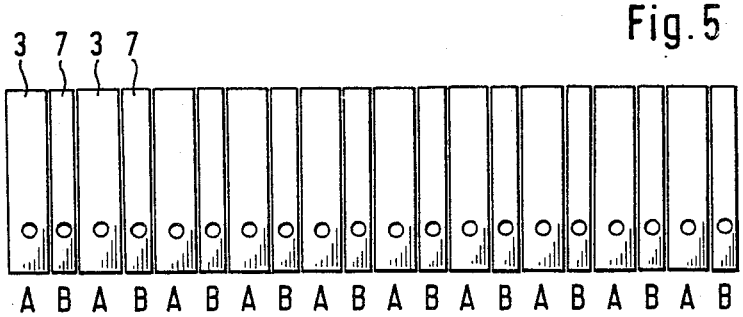
FIG. 5 shows a series of folders stacked next to one another with the wide back and the additional narrow back on a shelf.

The ordinarily unoccupied hollow spaces on the open sides of the folders are used in a simple manner by stacking alternately a folder A with the side back 3 next to a folder B with the narrow additional back 7 next to each other on the shelf as shown in FIG. 4. By placing the inscription on the wide folder back 3 and/or the narrow folder back 7, the alternating sequence can be easily maintained in the placement of the folders on the shelf, while the filing and removal of the vouchers or papers proceeds as previously.

The folder in accordance with the invention with the two covers 1, 2, the wide back 3 and the additional narrow back 7, the side edge strip 8, the insertion tongue 10 and the insertion slot 11 on the facing cover 1, can be produced from a single piece of hard cardboard or similar substance. By folding and bending of the connections of all parts following one another, it is possible to produce it as a mass-produced item on press machines. Through self-holding insertion closure, the folder permits the storage of papers and vouchers fastened inside it, in a closable briefcase-like container, and a better stand-up capability of adjacent folders through sequential placement. The invention allows alternating the wide and the additional narrow inscription backs on the front of the shelf, and results in saving considerable space.

An important characteristic of the combination file is the second identification back with about 30% space saving on the shelf. In addition, the file can also be used as a combination pocket file for the filing of papers. An important advantage is the single-piece manufacture as one-piece punched piece with folding creases, instead of sharp corners and all edge strips, wide and narrow back, insertion flap, insertion slot, slots for fastening bars, folded cross groove at the insertion flap, etc.

The combination file is a cheap mass-produced item, at reduced manufacturing cost and low price. It has many uses as a file for filing and as a jacket. It possesses simplified construction of corners by folds (creases) and folding over, 30% space saving when using the additional back on the sheld and single-piece punching from hard cardboard.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A file folder including: fastener means on the inside of said file folder; a wide back for carrying identification means; two covers extending from side edges of said wide back; a narrow back for carrying identification means connecting free side edges of said covers, said narrow back being formed on one of said covers holding said fastener means; a side edge strip reaching behind a free side edge of one of said covers; said narrow back being bent substantially at a right angle with said side edge strip as easly opened closure device such that said file folder during row-wise upright stacking on a shelf with a closed closure device forms a closed hollow element solidly enclosing contents with a horizontal cross-section; said file folder being placeable alternating said wide back and said narrow back for carrying identification; said file folder after opening said closure device being arranged in the usage position for storing and removal of individual file contents transversely to said fastener means.

2. A file folder as defined in claim 1, wherein said side edge strip on said additional narrow identification back has on its free edge a projecting insertion tongue, the facing folder cover having an associated insertion slot for receiving said insertion tongue.

3. A file folder including: fastener means on the inside of said file folder; a wide back for carrying identification means; two covers extending from side edges of said wide back; a narrow back for carrying identification means connecting free side edges of said covers, said narrow back being formed on one of said covers holding said fastener means; a side edge strip reaching behind a free side edge of one of said covers; said narrow back being bent substantially at a right angle with said side edge strip as easily opened closure device such that said file folder during row-wise upright stacking on a shelf with a closed closure device forms a closed hollow element solidly enclosing contents with a horizontal cross-section; said file folder being placeable alternating said wide back and said narrow back for carrying identification; said file folder after opening said closure device being arranged in the usage position for storing and removal of individual file contents transversely to said fastener means; said side edge strip on said additional narrow identification back having on its free edge a projecting insertion tongue, the facing folder cover having an associated insertion slot for receiving said insertion tongue; said insertion tongue on said edge strip has a cross groove produced by folding, a part of said insertion tongue projection beyond said cross groove by reaching around an edge of said insertion slot and producing through a friction a self-holding effect of said insertion tongue in said insertion groove.

4. A file folder as defined in claim 3 including passage slots for bows of said fastener means in one of said covers, said wide back for carrying identification; said covers, said narrow back for carrying identification, said side edge strip extending from a free edge of said narrow back, and said insertion tongue being combined into a single punched-out piece.

5. A file folder as defined in claim 3 including passage slots in one of said covers, said insertion tongue being formed in one piece attached to said free side edge of said side edge strip and having said cross groove on a side facing away from inside of said file folder so that a portion projecting beyond said cross groove by interaction with an edge of said insertion slot causes on one of said covers with said passage slots a self-holding effect of said insertion tongue in said insertion slot in a closed position of said file folder.

6. A file folder including: fastener means on the inside of said file folder; a wide back for carrying identification means; two covers extending from side edges of said wide back; a narrow back for carrying identification means connecting free side edges of said covers, said narrow back being formed on one of said covers holding said fastener means; a side edge strip reaching behind a free side edge of one of said covers; said narrow back being bent substantially at a right angle with said side edge strip as easily opened closure device such that said file folder during row-wise upright stacking on a shelf with a closed closure device forms a closed hollow element solidly enclosing contents with a horizontal cross-section; said file folder being placeable alternating said wide back and said narrow back for carrying identification; said file folder after opening said closure device being arranged in the usage position for storing and removal of individual file contents transversely to said fastener means; said side edge strip on said additional narrow identification back having on its free edge a projecting insertion tongue, the facing folder cover having an associated insertion slot for receiving said insertion tongue; said insertion tongue on said side edge strip having a cross groove produced by folding, a part of said insertion tongue projecting beyond said cross groove by reaching around an edge of said insertion slot and producing through friction a self-holding effect of said insertion tongue in said insertion groove; passage slots for bows of said fastener means in one of said covers, said wide back for carrying identification; said covers, said narrow back for carrying identification; said side edge strip extending from a free edge of said narrow back, and said insertion tongue being combined into a single punched-out piece; said insertion tongue being formed in one piece attached to said free side edge of said side edge strip and having said cross groove on a side facing away from inside of said file folder so that a portion projecting beyond said cross groove by interaction with an edge of said insertion slot causes on one of said covers with said passage slots a self-holding effect of said insertion tongue in said insertion slot in a closed position of said file folder.

* * * * *